US006374843B1

(12) United States Patent
Zou

(10) Patent No.: US 6,374,843 B1
(45) Date of Patent: Apr. 23, 2002

(54) SUPPORT STRUCTURE FOR COLLAPSIBLE SHELTER

(76) Inventor: Yinong Zou, 6 Anle Road, Jiaxing city, Zhejiang province (CN)

( * ) Notice: Subject to any disclaimer, the term of this patent is extended or adjusted under 35 U.S.C. 154(b) by 0 days.

(21) Appl. No.: 09/642,157

(22) Filed: Aug. 21, 2000

(30) Foreign Application Priority Data

Aug. 21, 1999 (CN) ..... ZL99239367 U

(51) Int. Cl.[7] ..... E04H 15/50

(52) U.S. Cl. ..... 135/145; 135/144; 135/143; 135/146; 135/158; 52/641; 52/646

(58) Field of Search ..... 135/145, 146, 135/143, 141, 157, 156, 158, 129, 128, 121, 151, 131; 52/641, 646

(56) References Cited

U.S. PATENT DOCUMENTS 4,607,656 A 8/1986 Carter
5,421,356 A * 6/1995 Lynch ..... 135/145
6,089,247 A * 7/2000 Price ..... 135/145
6,173,726 B1 * 1/2001 Talmadge ..... 135/144
6,240,940 B1 * 6/2001 Carter ..... 135/145

FOREIGN PATENT DOCUMENTS

CN 95236844.7 3/1997
CN 96230627.4 10/1998

* cited by examiner

*Primary Examiner*—Carl D. Friedman
*Assistant Examiner*—Jennifer I. Thissell
(74) *Attorney, Agent, or Firm*—Rabin & Berdo, P.C.

(57) ABSTRACT

A support structure for a collapsible shelter, includes legs and upper beams hinged together. Each upper beam is composed of two component rods connected with each other by a freely swinging hinge. Each leg has a sliding part thereon. There is provided an upper or upward stay bar between the sliding part on each leg and the component rods of the upper beam respectively. Both end connections of the top stay bar are freely swinging hinges. The leg has also a stop means thereon to limit motion of the sliding part in outspread state. The support structure does not need to be assembled and dismantled each time when it is to be used and can be easily and quickly spread out and collapsed, saving both time and manpower.

6 Claims, 5 Drawing Sheets

SUPPORT STRUCTURE FOR COLLAPSIBLE SHELTER

BACKGROUND OF THE INVENTION

The present invention relates to a support structure for an ordinary shelter or tent, and particularly to a support structure for a collapsible shelter.

Nowadays, shelters are extensively used in recreation, amusement and touring. A shelter usually comprises a canvas covering and a support structure, which in turn is constituted of legs, beams and sometimes also top bars. The construction of said shelter is designed such that it can be dismantled and assembled readily. The various members of the support structure and canvas covering are assembled whenever it is to be used, and after use, all of them are dismantled for the ease of portability. But it is rather tedious to reassemble the entire support structure and canvas covering every time when it is to be used. A shelter of collapsible construction such as disclosed in U.S. Pat. No. 4,607,656 could be conveniently collapsed, stored and transported, but the canvas covering in this case cannot be fully spread out due to lack of beams so as to affect its effectiveness in use.

SUMMARY OF THE INVENTION

The present invention aims to provide a support structure for a collapsible shelter which is easily and quickly spread and collapsed with no need to dismantle and assemble it every time when it is to be used.

To achieve this aim, the support structure for a collapsible shelter of the present utility model comprises legs and upper beams etc., at least three in number for each of them, with the top ends of the legs being connected respectively with the upper beams. Wherein each said upper beam is composed of two separate component rods jointed together by a hinge to freely swing with respect to each other. The two ends of the upper beam are connected to the top end of the adjacent legs respectively by freely swinging hinges. Each said leg has a sliding part thereon. There is an upper stay bar or upward stay bar between the sliding part and the component rods of the upper beam connected to the leg. Both end connections of the upper stay bar are freely swinging hinges. Said leg has also a stop means thereon to limit motion of the sliding part during spreading.

In addition, said support structure for a collapsible shelter has at least three lower beams. Each said lower beam is composed of two separate component rods jointed together by a hinge to freely swing with respect to each other. The two external ends of each said lower beam are connected to sliding parts of adjacent legs through freely swing hinges respectively. There is a lower stay bar or downward stay bar respectively between the top of the leg and the component rods of the lower beam connected to the leg. Both end connections of the lower stay bar are freely swinging hinges.

Moreover, said support structure for a collapsible shelter has at least three top bars, each of which is in turn composed of two separate component bars jointed together by hinge to freely swing with respect to each other. One of the external ends of each said top bar is jointed to the top end of a leg through a freely swinging hinge, while the other end of all top bars are jointed together by a freely swinging hinge. There is a top stay bar respectively between the sliding part on the leg, and the component bars of the top bar connected to the leg. Both end connections of the top stay bar are freely swinging hinges.

With the above structure, after a canvas covering is fixed on the upper beams or top bars of the support structure, a collapsible shelter is formed. While in use, as the sliding parts are sliding upward along the legs, triangles are formed by the upper stay bar, leg and a component rod of upper beam, by lower or downward stay bar, leg and a component rod of lower beam, and also by top stay bar, leg and a component bar of top bar respectively. As the upward motion goes forward, these triangles are transformed continuously due to the relative swinging between them through hinges. The transformation would not be ceased until the two component rods of each upper and lower beam are connected in a straight line, all upper and lower beams outspread straightly and the support structure is erected completely. At this time, the sliding part is locked up by stop means of the leg to prevent collapse of the shelter on account of a downward motion of the sliding part, and the shelter is now completely outspread and ready for use. While the shelter is not used, the stop means is released, and sliding part moves downward along the leg, which result in a series of the following motions: the upper stay bar pulls the adjacent component rod of the upper beam to swing downward; the component rod of the low beam swings upward and pulls the lower stay bar to swing downward; the top stay bar pulls the top bar to swing downward (i.e. a reverse transformation of triangles during the above process of shelter outspreading). Upper beams, lower beams and top bars are folded gradually, and all legs move toward the common center until the support structure and canvas covering are fully collapsed and folded completely. Therefore, collapsible shelter with the present support structure does not need to be assembled and dismantled each time when it is to be used. Said collapsible shelter can be easily and quickly spread out and collapsed, saving both time and manpower. The canvas covering can also be fully outspread due to presence of beams and top bars, thus enhancing sheltering effect.

DETAILED DESCRIPTION OF THE DRAWINGS

With reference to embodiment and accompanying drawings, the present invention is further described in detail in the following.

Figure 1:
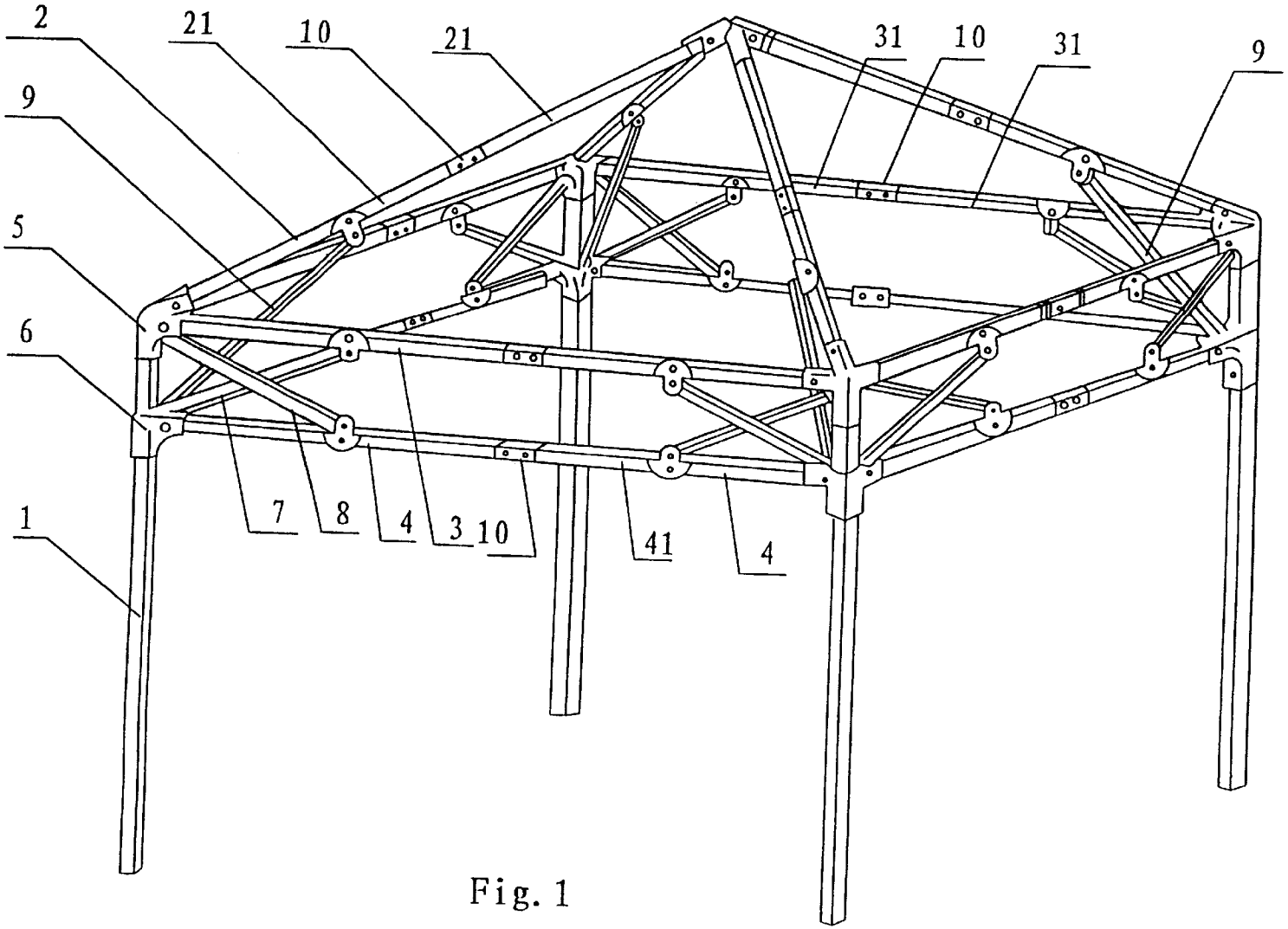
FIG. 1—A schematic drawing of support structure for collapsible shelter which is in fully spread-out state, FIG. 2—A schematic drawing showing connection of a corner of support structure in FIG. 1, FIG. 3—A schematic drawing of connection of structural members on the leg in FIG. 1, FIG. 4—A schematic drawing of transformation of shape during the collapsing process of support structure, FIG. 5—A schematic drawing of collapsed support structure for collapsible shelter.
Figure 2:
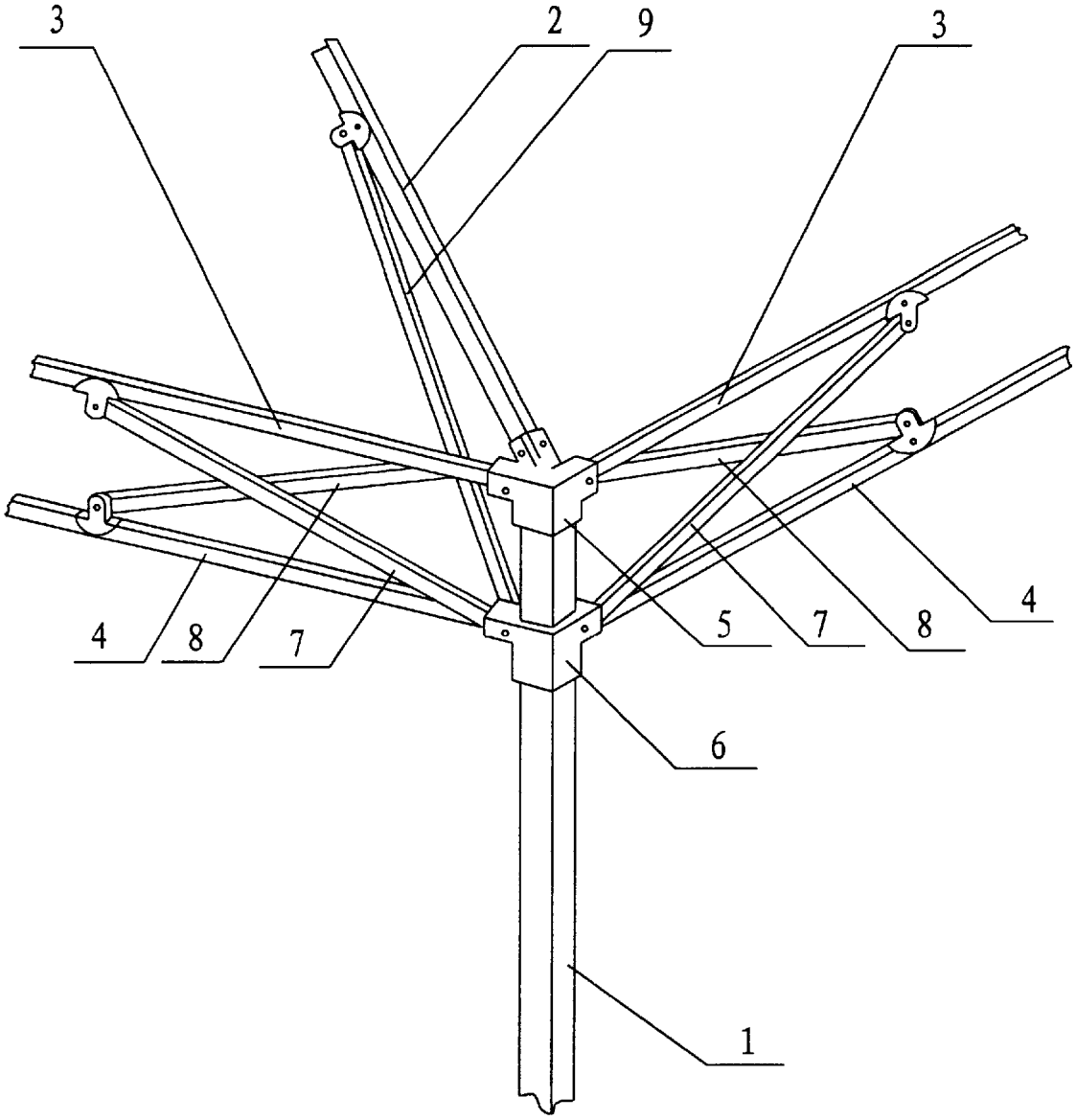
Figure 3:
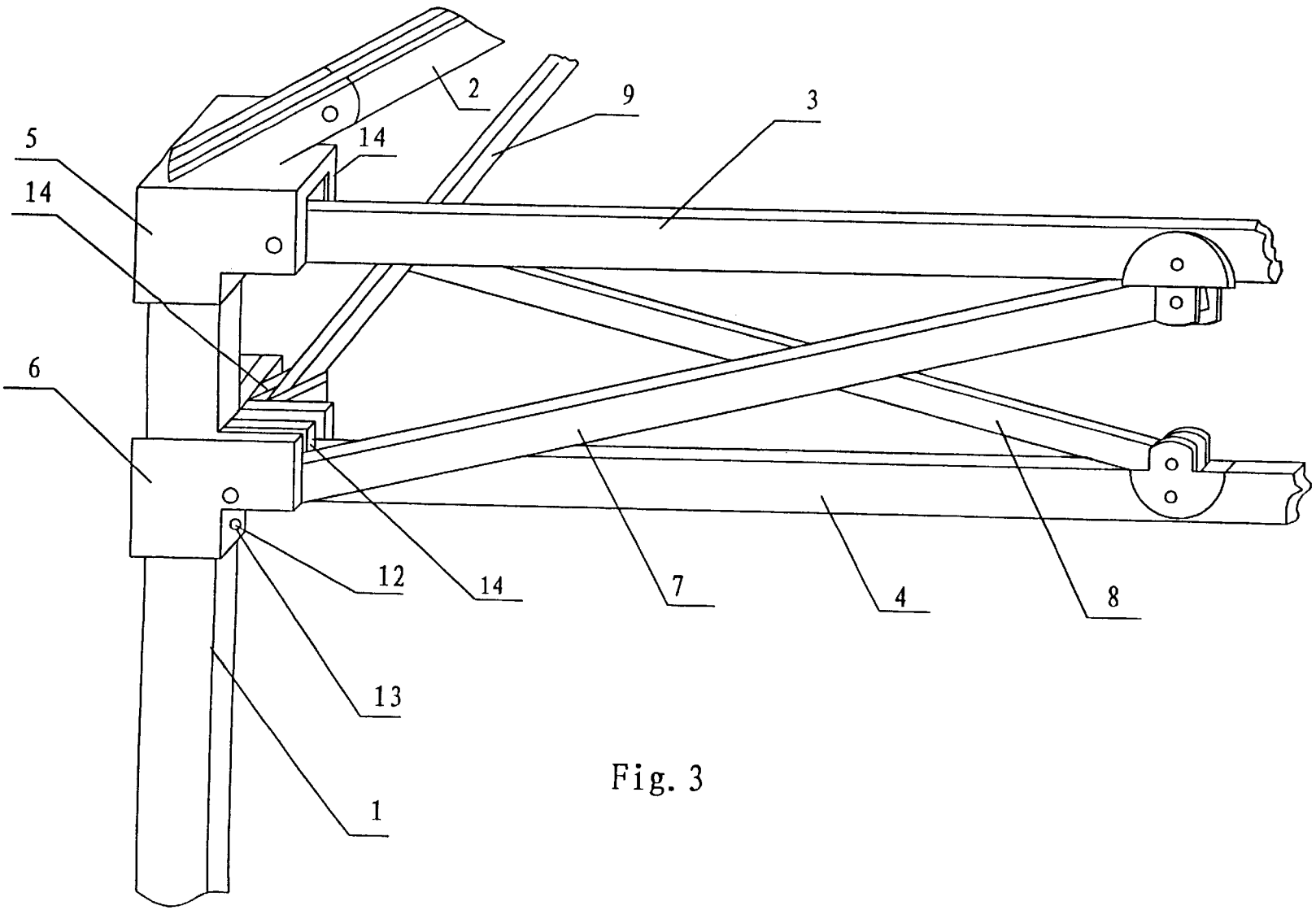
Figure 4:
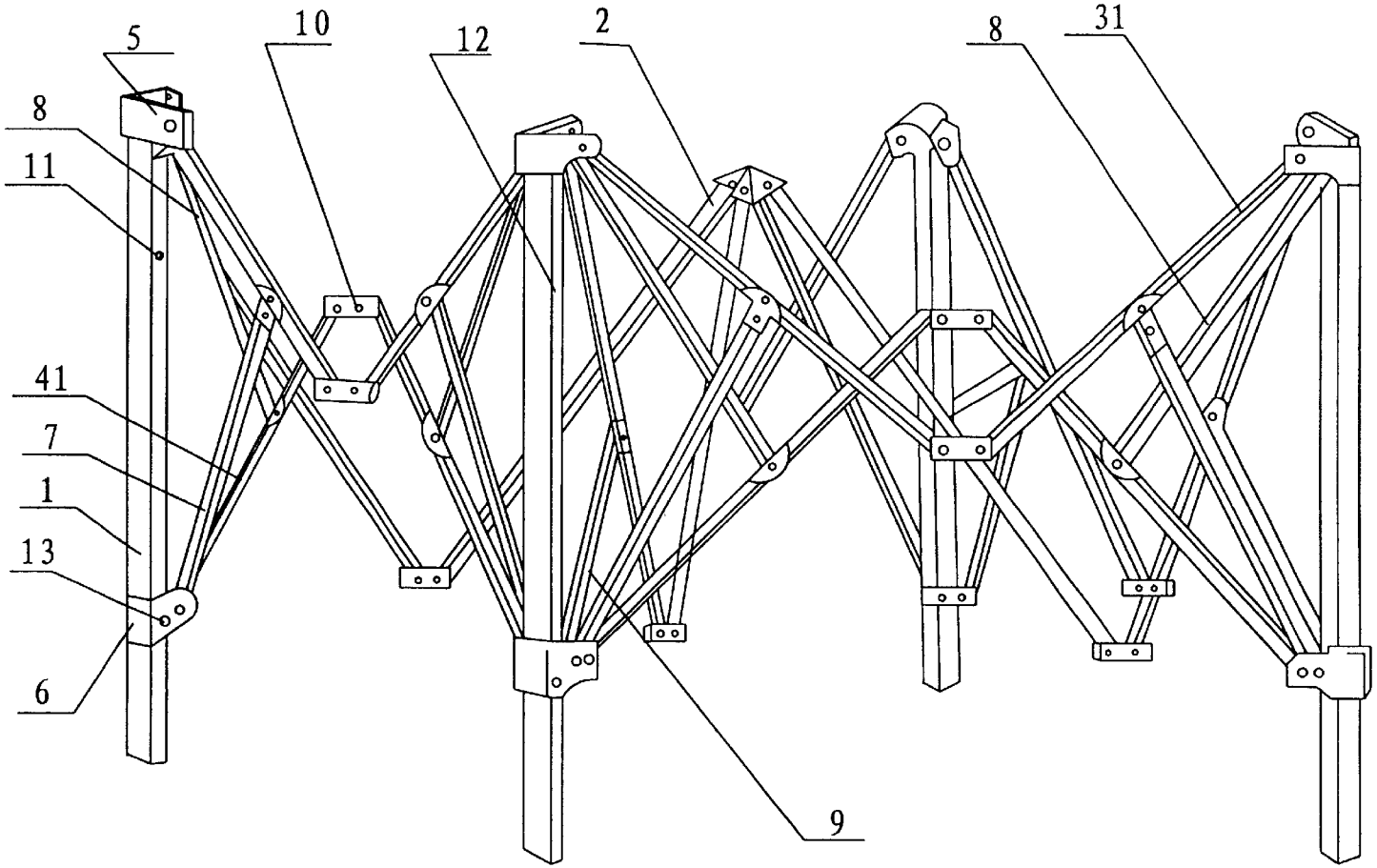
Figure 5:
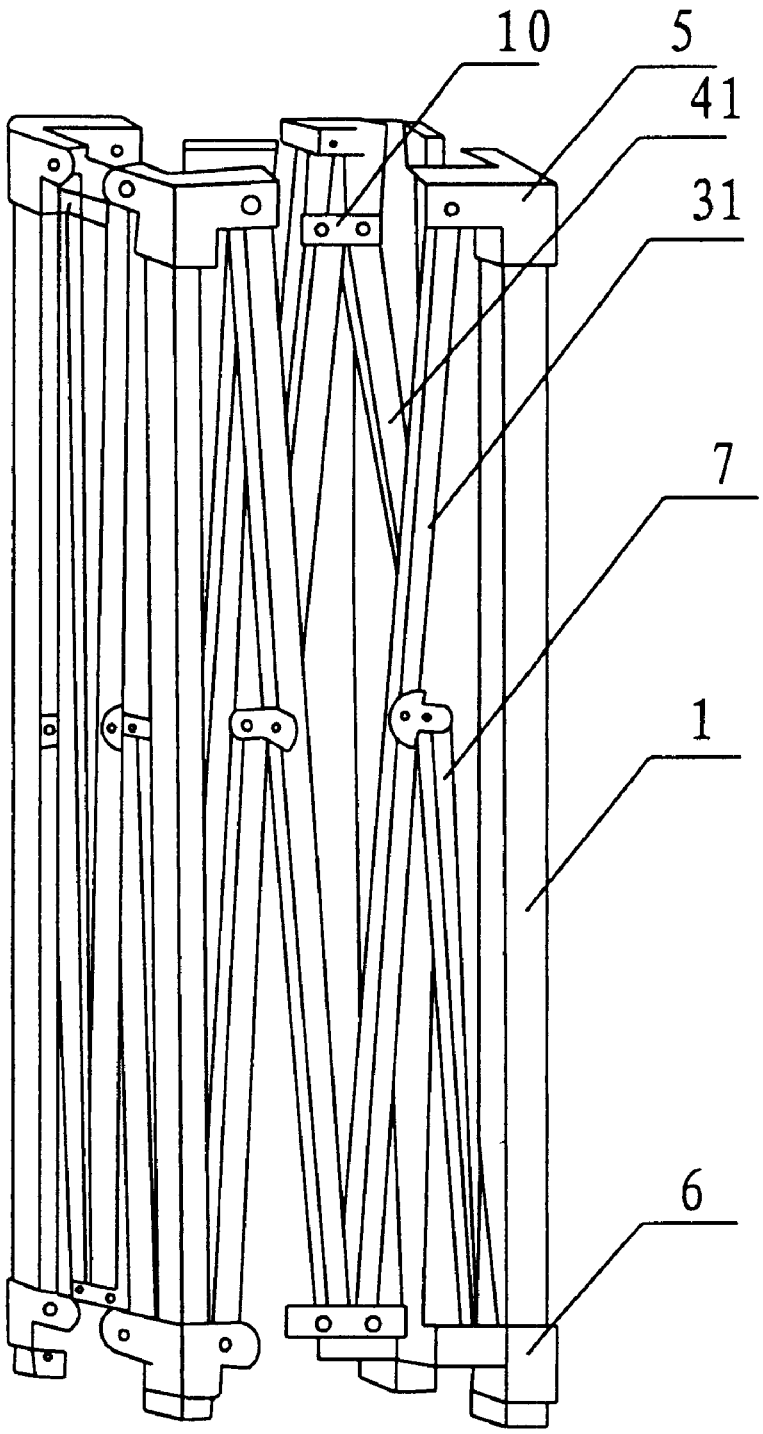

As shown in the figures, the support structure for a collapsible shelter of the present invention comprises four legs 1, four top bars 2, four upper beams 3 and four lower beams 4. A block 5 with hinges in multiple directions is fixed on the top of each leg 1, and said block 5 is basically rectangular in shape. Two hinged slots 14 on each side of a top right angle are cut downward on each said block 5, and another hinged slot 14 on top of the right angle is cut in a diagonal direction. All hinged slots are used for freely hinged connection with other structural members. Each upper beam 3 is composed of two separate component rods 31 connected together by a freely swinging hinge, and the two outermost ends of the upper beam 3 are hinged freely to multi-directional hinged blocks 5 respectively. Each leg 1 is slipped into a sliding part 6, which is also basically rectangular in shape and is provided with a hole at its corner for mating with the leg 1. Two hinged slots 14 for each side of a top right angle are cut upward on each said sliding part 6, and another hinged slot 14 on top of the right angle is cut in a diagonal direction. All hinged slots are used for freely hinged connection with other structural members. There is provided respectively an upper stay bar or upward stay bar between each sliding part 6 and the component rods 31 of the upper beam, and both ends of upper stay bar 7 are freely hinged. Each lower beam 4 is also composed of two separate component rods 41 connected together by a freely swinging hinge, and the two external (outermost) ends of lower beams 4 are hinged freely to sliding parts 6 on adjacent legs 1 respectively. A lower stay bar or downward stay bar 8 is provided between the multi-directional hinged block 5 of the top end of the leg 1 and the component rods 41 of the lower beam connected to the leg. The two ends of the lower or downward stay bar 8 are both freely hinged. Each top bar 2 is composed of two separate component bars 21 freely hinged together, and an external (outermost) end of each top bar is connected to the diagonal hinged slot 14 of the multi-directional hinged block 5 on top of leg 1 respectively through freely swinging hinge. The other ends of all top bars 2 are hinged together freely. The diagonal hinged slot 14 of sliding part 6 on each leg 1 is connected to an adjacent component bar 21 of the top bar respectively through a top stay bar 9, of which two ends are both freely hinged. The connection mode of the other three supporting legs of the support structure is all the same as shown in FIG. 2. To improve agility of the relative swinging between the component bars, i.e., between the two component bars 21 of top bar 2, between the two component rods 31 of upper beam 3, and between the two component rods 41 of lower beam 4, a bi-directional hinged block 10 is respectively provided, which block has a slot for a hinge at each end. To lock the sliding part 6 so as to prevent it from slipping down from the outspread state of the support structure, on each leg 1 is provided a hole 11, in which is set up a spring projection 12, and at the corresponding position of sliding part 6 a through hole 13 is defined for accepting projection 12. When sliding part 6 is moved upward until it is in contact with projection 12, the latter can allow the sliding part 6 to move up a certain distance farther until the position of projection 12 coincides with the hole 13, and at this point the projection 12 springs out to be inserted into the hole 13. At that time sliding part 6 can no longer be moved, and the support structure is rigidly and stably spread out. At time of collapsing, the spring projection 12 is pushed down; the sliding part 6 can be slipped down to allow all members of support structure to collapse down till completely folded. Other devices can also be used to stop the sliding part 6, e.g. no through hole is provided on sliding part 6 and the springing up projection 12 is used to directly limit the motion of sliding part at its bottom; or a through hole is provided on leg 1 so that in the outspread state of the support structure the bottom of sliding part is just above said hole, and a crosswise pin is inserted in the hole to restrict the sliding part 6.

In the above embodiment, the purpose of using lower beam 4 and lower stay bar 8 is to further strengthen the stability of support structure and canvas covering in outspread state, and the top bars 2 and top stay bars 9 are provided to improve the rainproof effect of canvas covering in addition to shielding sunlight. The present invention is suitable for the manufacture of a shelter used for recreation, amusement and outdoor touring.

What is claimed is:

1. A support structure for a collapsible shelter, comprising:

at least three legs;

at least three upper beams, each said upper beam including two separate component rods jointed together by a hinge to swing freely relative to each other, two opposing ends of each said upper beam being connected to top ends of respective adjacent legs by freely swinging hinges;

a plurality of sliding parts, each leg having a respective one of said sliding parts thereon;

a plurality of upper upward stay bars, each having one end connected to a respective sliding part disposed on a respective leg, and each having another end connected to the component rod of the upper beam attached to the respective leg, both end connections of the upper upward stay bar being freely swinging hinges;

stop means disposed on said legs for limiting motion of the sliding part when said support structure is in an outspread state;

at least three lower beams, each said lower beam including two separate component rods jointed together by a hinge to swing freely relative to each other, two outermost ends of each said lower beam being connected to respective sliding parts on adjacent legs through respective freely swing hinges; and a plurality of lower, downward stay bars, each having one end connected to the top end of a respective leg, and another end connected to the component rod of the lower beam connected to the respective leg, both end connections of the lower, downward stay bar being freely swinging hinges.

2. The support structure as defined in claim 1, further comprising a plurality of bi-directional hinged blocks, each connecting said two component rods of a respective upper beam, said bi-directional hinged block having a slot for a hinge at each end.

3. The support structure as defined in claim 1, further comprising a multi-directional hinged block fixed on the top of each leg, said multi-directional hinged block having slots for hinges.

4. The support structure as defined in claim 1, further comprising a plurality of bi-directional hinged blocks, each connecting said two component rods of a respective lower beam.

5. The support structure as defined in claim 1, further comprising at least three top bars, each of which includes two separate component bars jointed together by a hinge to freely swing relative to each other, one of the outermost ends of each said top bar being jointed to the top end of a respective leg through a freely swinging hinge, while the other end of all of said top bars being jointed together by a freely swinging hinge; and a top stay bar disposed between the sliding part on the leg, and the component rods of the top bar connected to the leg respectively, both end connections of the top stay bar being freely swinging hinges.

6. A support structure for a collapsible shelter, comprising:

a plurality of legs;

a plurality of upper beams, each said upper beam including a plurality of separate component rods pivotally joined together, each said upper beam having one end pivotally connected to one of said legs, and another end pivotally connected to another one of said legs;

a plurality of sliding parts, each being disposed on a respective leg;

a plurality of upper stay bars, each having one end pivotally connected to a respective sliding part, and another end pivotally connected to the component rod of a respective one of said upper beams;

stop means disposed on at least one of said legs for limiting motion of said sliding part when said support structure is in an outspread state;

a plurality of lower beams, each including a plurality of separate component rods pivotally joined together, each lower beam having one end pivotally connected to one of said sliding parts, and another end pivotally connected to another one of said sliding parts; and a plurality of lower stay bars, each having one end pivotally connected to the top end of a respective one of said legs, and another end pivotally connected to the component rod of a respective one of said lower beams.

* * * * *